US012110150B2

(12) United States Patent
Huff

(10) Patent No.: US 12,110,150 B2
(45) Date of Patent: Oct. 8, 2024

(54) CONTAINER

(71) Applicant: INNOVATE MANUFACTURING, INC., Knoxville, TN (US)

(72) Inventor: Leonard Scott Huff, Knoxville, TN (US)

(73) Assignee: INNOVATE MANUFACTURING, INC., Knoxville, TN (US)

( * ) Notice: Subject to any disclaimer, the term of this patent is extended or adjusted under 35 U.S.C. 154(b) by 14 days.

(21) Appl. No.: 17/743,939

(22) Filed: May 13, 2022

(65) Prior Publication Data

US 2022/0388719 A1 Dec. 8, 2022

(30) Foreign Application Priority Data

Jun. 4, 2021 (CN) ..... 202121265095.1

(51) Int. Cl.
*B65D 23/08* (2006.01)
*B65D 43/02* (2006.01)
*B65D 47/06* (2006.01)

(52) U.S. Cl.
CPC ..... *B65D 23/0807* (2013.01); *B65D 43/0231* (2013.01); *B65D 47/06* (2013.01); *B65D 2203/02* (2013.01)

(58) Field of Classification Search
CPC ..... B65D 43/0231; B65D 47/06
See application file for complete search history.

(56) References Cited

U.S. PATENT DOCUMENTS 4,883,697 A * 11/1989 Dornbusch ..... B29C 49/24 40/310
5,326,006 A * 7/1994 Giard, Jr. ..... B62J 11/04 224/440

(Continued)

FOREIGN PATENT DOCUMENTS

CA 2814674 11/2013 ..... B29C 45/14
CN 107310810 A 11/2017 ..... B65D 1/02

(Continued)

OTHER PUBLICATIONS

Second Office Action issued in Chinese Application No. 202210466753.6 (with machine translation), dated Dec. 15, 2022, 15 pgs.

(Continued)

*Primary Examiner* — Andrew T Kirsch
(74) *Attorney, Agent, or Firm* — HAYES SOLOWAY P.C.

(57) ABSTRACT

The present application discloses a novel container, which comprises: a bottle body that has a fitting area in concave shape arranged on the outer surface; a protection layer arranged on the fitting area; a pattern layer arranged on a side surface of the protection layer away from the fitting area; a light-transmittable wrapping layer arranged on the pattern layer; a bonding layer is arranged on a side edge of the light-transmittable wrapping layer, the light-transmittable wrapping layer connects with the side edge of the fitting area through the bonding layer. By arranging the fitting area on the bottle body, the protection layer in the fitting area, the pattern layer on the side surface of the protection layer away from fitting area, and the light-transmittable wrapping layer on the pattern layer, the pattern layer is protected effectively.

16 Claims, 2 Drawing Sheets

(56) References Cited

U.S. PATENT DOCUMENTS

| | | | | |
|---|---|---|---|---|
| 7,210,602 | B2 * | 5/2007 | Blancheste | B65D 47/0842 222/464.5 |
| 2003/0006605 | A1 * | 1/2003 | Ross | G09F 3/02 283/81 |
| 2006/0198978 | A1 * | 9/2006 | Antonini | B32B 33/00 428/41.8 |
| 2007/0048480 | A1 | 3/2007 | Lavosky | B32B 33/00 |
| 2018/0249853 | A1 | 9/2018 | Fu et al. | A47G 23/02 |
| 2021/0035474 | A1 | 2/2021 | Bartlein | G09F 3/00 |
| 2022/0379650 | A1 | 12/2022 | Mckillip et al. | B42D 25/36 |

FOREIGN PATENT DOCUMENTS

| | | | | |
|---|---|---|---|---|
| CN | 211324611 | U | 8/2020 | A47K 5/00 |
| CN | 215922889 | U | 3/2022 | B65D 23/14 |
| CN | 215922890 | U | 3/2022 | B65D 23/14 |

OTHER PUBLICATIONS

Yixin, "Modern Printing Anti-counterfeiting Technology", China Light Press, ISBN 7-5019-5657-X, 2007, with abstract, 5 pgs.
Yanfen, "Postpress Processing Technology" Shanghai Jiaotong University Press, ISBN 97807-313-04958-2, 2008, with abstract, 5 pgs.
First Office Action issued in Chinese Application No. 202210466753.6 (with translation), dated Oct. 8, 2022, 13 pgs.
Office Action issued in U.S. Appl. No. 17/812,948, dated Jun. 12, 2023, 21 pgs.
Office Action issued in U.S. Appl. No. 17/812,948, dated Oct. 16, 2023, 11 pgs.

* cited by examiner

CONTAINER

CROSS-REFERENCE TO RELATED APPLICATIONS

This application claims priority to Chinese Patent Application No. 202121265095.1, filed on Jun. 4, 2021. The content of all of which is incorporate herein by reference.

FIELD OF THE INVENTION

The present application relates to the technical field of a container, in particular to a novel container.

BACKGROUND

Bottle is a commonly used container in our daily life, such as a beverage bottle, which typically has a decorative label (or artwork) on its exterior surface. However, during transportation, the beverage bottle may be subjected to vibration and collision, and the label on the beverage bottle can be easily scratched and damaged. Daily usage and cleaning may also result in wear to the label. In addition a single-layer label on the bottle body can only generate a 2D decoration affect, and it is hard to generate any 3D decoration affect, especially along the depth direction of the label.

Therefore, the current technology needs to be improved and developed.

BRIEF SUMMARY OF THE DISCLOSURE

According to the defects in the prior art described above, the present application provides a novel container to solve the problem that the pattern of the label on the beverage bottle in the prior art is easily scratched and damaged.

The technical solution of the present application to solve the problem is as follows:

In a first aspect, an embodiment of the present application provides a novel container, which comprises:

- a bottle body, a fitting area in a concave shape is arranged on an outer surface of the bottle body;
- a protection layer arranged on the fitting area;
- a pattern layer arranged on a side surface of the protection layer away from the fitting area;
- a light-transmittable wrapping layer arranged on the pattern layer; wherein a bonding layer is arranged on a side edge of the light-transmittable wrapping layer, and the light-transmittable wrapping layer connects with a side edge of the fitting area through the bonding layer.

In a further improved technical solution, in the novel container, a plurality of protrusions are arranged on a side surface of the light-transmittable wrapping layer away from the fitting area.

In a further improved technical solution, the novel container further comprises a bottle cap screwed on an opening which is arranged on the bottle body and has a thread arranged on an outer surface.

In a further improved technical solution, in the novel container, a suction nozzle has a straw inside is arranged on the bottle cap, the straw is extended to be arranged inside the bottle body.

In a further improved technical solution, in the novel container, the fitting area is arranged symmetrically on the outer surface of the bottle body, which has a shape adapted to a shape of the protection layer and a shape of the light-transmittable wrapping layer.

In a further improved technical solution, in the novel container, the plurality of protrusions are in cylindrical shapes or hemispherical shapes.

In a further improved technical solution, in the novel container, a material of the light-transmittable wrapping layer is a transparent elastomer.

In a further improved technical solution, in the novel container, a material of the bottle body is a plastic or a metal.

In a further improved technical solution, in the novel container, a window that penetrates through the light-transmittable wrapping layer is arranged on the light-transmittable wrapping layer.

In a further improved technical solution, in the novel container, a material of the protection layer is a plastic.

Comparing to the prior art, advantages of the present application are as follow:

The novel container provided by the present application comprises: a bottle body, a fitting area in a concave shape is arranged on an outer surface of the bottle body; a protection layer arranged on the fitting area; a pattern layer arranged on a side surface of the protection layer away from the fitting area; a light-transmittable wrapping layer arranged on the pattern layer; wherein a bonding layer is arranged on a side edge of the light-transmittable wrapping layer, and the light-transmittable wrapping layer connects with a side edge of the fitting area through the bonding layer. By arranging the fitting area on the bottle body, the protection layer in the fitting area, the pattern layer on the side surface of the protection layer away from the fitting area, and the light-transmittable wrapping layer on the pattern layer, the present application is able to protect the pattern layer effectively. The pattern layer in the novel container provided by the present application is arranged between the light-transmittable wrapping layer and the protection layer, so that the pattern can be free from wear.

Figure 1:
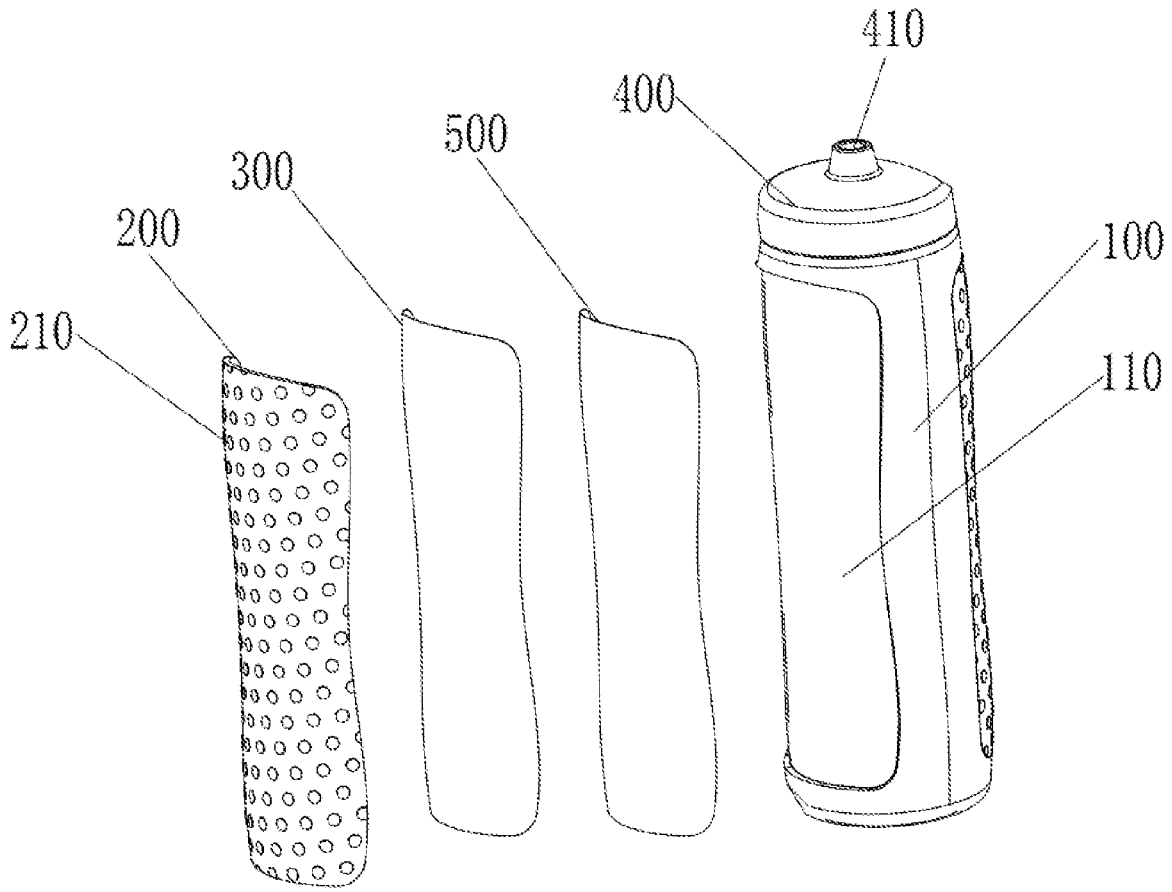
FIG. 1 is a structural diagram on a first embodiment of the novel container provided by the present application.

Wherein: 100. bottle body; 200. light-transmittable wrapping layer; 300. pattern layer; 500. protection layer; 110. fitting area; 201. window; 210. protrusion; 400. bottle cap; 410. suction nozzle.

DETAILED DESCRIPTION OF EMBODIMENTS

In order to make the purpose, technical solution and the advantages of the present application clearer and more explicit, further detailed descriptions of the present application are stated herein, referencing to the attached drawings and some embodiments of the present application. It should be understood that the detailed embodiments described here are used to explain the present application only, instead of limiting the present application.

It should be noted that when a component is referred to as being "fixed to" or "arranged on" another component, it can be directly or indirectly set on the another component. When a component is referred to as being "connected to" another component, it can be directly or indirectly connected to the other component.

It should be further noted that a same or a similar mark in the drawings of the embodiments corresponds to a same or a similar component; in the description of the present application, it should be understood that if there is an orientation or a positional relationship indicated by terms including "upper", "lower", "left", "right", and more, based on accompanying drawings, is the purpose is only for a convenience of describing the present application and simplifying the description, rather than indicating or implying that the indicated device or element must have a specific orientation, or be constructed and operated in a specific orientation. Therefore, the terms describing the position relationships in the accompanying drawings are only used for exemplary illustration, instead of being construed as a limitation on the present application. For those skilled in the art, the meanings of the above terms can be understood according to specific situations.

In addition, the terms "first" and "second" are only used for descriptive purposes, instead of being construed as indicating or implying relative importance or implying the number of the indicated technical features. Thus, a feature defined as "first" or "second" may expressly or implicitly include one or more of the feature. In the description of the present application, "a plurality of" means two or more, unless otherwise being expressly and specifically defined.

EMBODIMENTS

Figure 2:
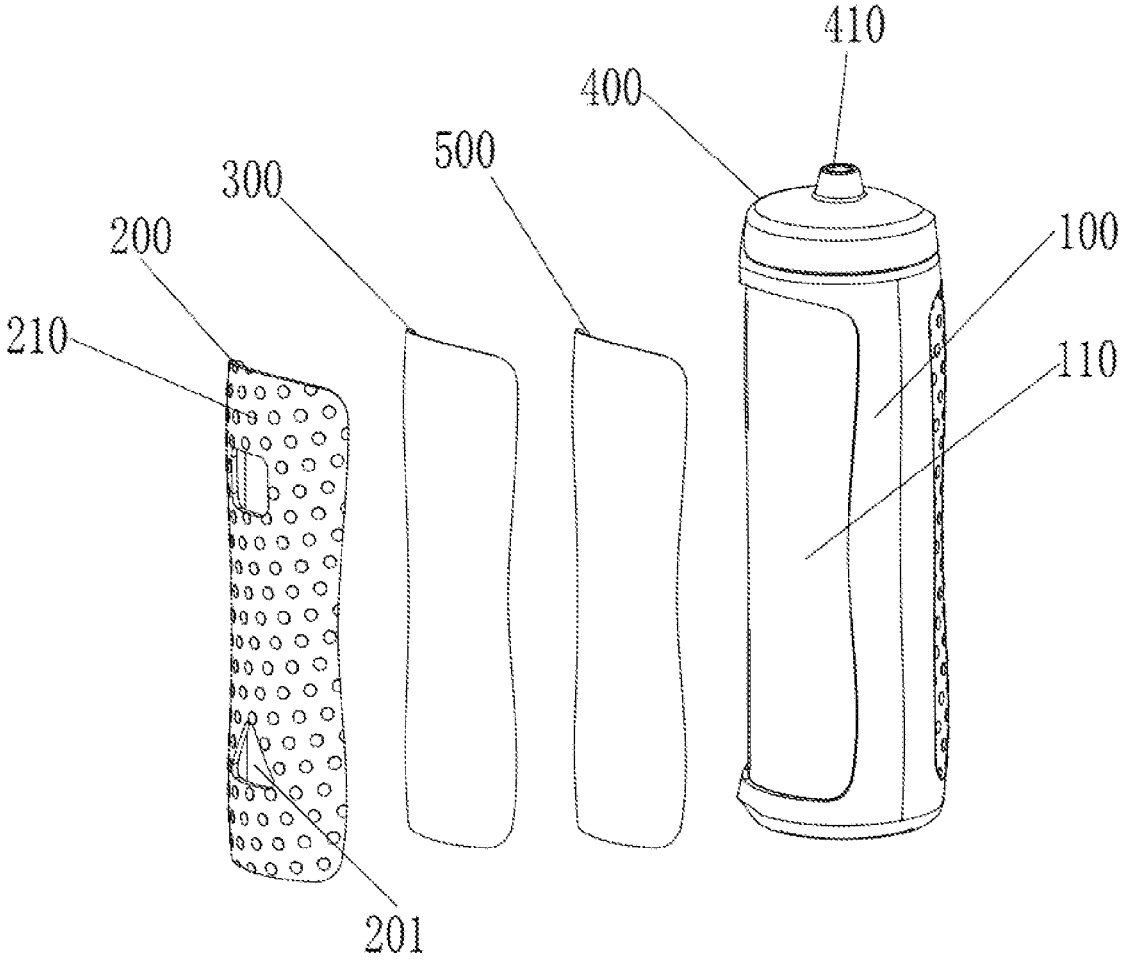
FIG. 2 is a structural diagram on a second embodiment of the novel container provided by the present application.

Referencing to FIG. 1 and FIG. 2 together, FIG. 1 is a structural diagram on a first embodiment of the novel container provided by the present application; FIG. 2 is a structural diagram on a second embodiment of the novel container provided by the present application. The novel container comprises: a bottle body 100, a protection layer 500, a light-transmittable wrapping layer 200, and a pattern layer 300. The bottle body 100 is in a cylindrical shape, and a material of the bottle body 100 is plastic or metal. In an embodiment, when the material of the bottle body 100 is plastic, it may be one of PP (polypropylene), PE (polyethylene), PC (polycarbonate), TRITAN (tritan copolyester), PET (polyethylene terephthalate), EVA (ethylene-vinyl acetate copolymer), and more. The bottle body 100 can be formed by molding, and, of course, can also be formed by extrusion blow molding. A fitting area 110 configured to accommodate the protection layer 500, the pattern layer 300, and the light-transmittable wrapping layer 200 is in a concave shape and arranged on an outer surface of the bottle body 100.

The protection layer 500 is a thin film layer, configured to protect the pattern layer 300 to prevent the pattern layer 300 from scratching the bottle body 100 in the fitting area 110. A material of the protection layer 500 is plastic. During an actual production, after the pattern layer 300 is connected with the protection layer 500, the protection layer 500 and the pattern layer 300 are both attached to a side surface of the light-transmittable wrapping layer 200 facing the fitting area 110. Optionally, it is possible to attach both the protection layer 500 and the pattern layer 300 to the side surface of the light-transmittable wrapping layer 200 facing the fitting area 110 by using an in-molding label (IML) process, making the pattern layer 300 locate between the protection layer 500 and the light-transmittable wrapping layer 200. It should be understood that the in-molding label process belongs to the prior art, thus no more descriptions on a working principle thereof are presented in details in the present application.

The light-transmittable wrapping layer 200 is arranged on the pattern layer 300, optionally, the light-transmittable wrapping layer 200 may be obtained by the method of injection mold, extrusion mold, compression mold, or liquid injection mold (LIM); further, the material of the light-transmittable wrapping layer 200 is an elastomer, in an embodiment, it may be TPE (thermoplastic elastomer), TPU (thermoplastic polyurethane), or other elastomers, of course, silicon is also an option. It should be noted that, the light-transmittable wrapping layer 200 may be transparent, translucent, transparent with a color, with multi-color or mono-color. Of course, the material may also be a light-transmittable material with color chips or flakes, or other metal powders, or a material containing environment-friendly waste or recyclable waste. Further, the light-transmittable wrapping layer 200 connects with a side edge of the fitting area through a bonding layer (not shown in the drawings) which is arranged on the light-transmittable wrapping layer 200.

Further, the pattern layer 300 is arranged on a side surface of the protection layer 500 away from the fitting area 110, wherein the pattern layer 300 is a layer having patterns, attached to the protection layer 500 and located between the protection layer 500 and the light-transmittable wrapping layer 200. When both the light-transmittable wrapping layer 200 and the protection layer 500 are arranged in the fitting area 110, the pattern layer 300 is protected by both the protection layer 500 and the light-transmittable wrapping layer 200. In an daily usage, the pattern layer 300 may be a product logo or a plurality of various product patterns, text information, and more, a specific content of the pattern layer 300 shall be settled according to an actual need. The pattern layer 300 may be printed onto the protection layer 500 by an offset printing technology which is a printing technology that graphics and/or text on an intermediate carrier is transferred to a substrate by adopting a corresponding pressure, includes: water transfer printing, air transfer printing, screen transfer printing, and heat transfer printing. Of course, the pattern layer 300 may also be printed on the protection layer 500 by a digital printing technology (a new printing technology that transmits graphics and/or text information to a digital printing machine online for color printing using a pre-print system).

Of course, on a side surface of the light-transmittable wrapping layer 200 away from the pattern layer 300, another layer of patterns may further be printed, preferably a same pattern as that on the pattern layer 300 is adopted. By arranging the pattern layer 300 between the light-transmittable wrapping layer 200 and the protection layer 500, the transparency of the light-transmittable wrapping layer 200 together with other composite materials added (the color flakes or the other metal powders), as well as an additional pattern printed on an outer surface of the light-transmittable wrapping layer 200, would help present a multi-layered decorative effect on the bottle body 100 and enhance an attractiveness of the product.

In the embodiments of the present application, the protection layer 500 and the pattern layer 300 are bonded to the side surface of the light-transmittable wrapping layer 200 facing the fitting area 110 through the in-molding label process or other laminating process, making the pattern layer locate between the protection layer 500 and the light-transmittable wrapping layer 200. Therefore the protection layer 500, the pattern layer 300 and the light-transmittable wrapping layer 200 are attached to the fitting area 110. In the embodiments of the present application, the pattern layer 300 of the novel container is arranged between the light-transmittable wrapping layer 200 and the protection layer 500, to protect the pattern layer 300 effectively and prevent the patterns from wear.

Further, in order to meet a requirement of both symmetry and beauty, the fitting area 110 is arranged on the outer surface of the bottle body 100 symmetrically, wherein the fitting area 110 is in a concave shape, and a shape of the fitting area 110 adapts to a shape of the protection layer 500 and a shape of the light-transmittable wrapping layer 200, so that the light-transmittable wrapping layer 200 is better positioned, and it is convenient for arranging the light-transmittable wrapping layer 200 into the fitting area 110 quickly. At the same time, a concave design of the fitting area 110 can also prevent the light-transmittable wrapping layer 200 from protruding on a surface of the bottle body 100, thereby preventing the light-transmittable wrapping layer 200 from being separated from the bottle body 100.

Furthermore, a shape of the pattern layer 300 adapts to a shape of the side surface of the light-transmittable wrapping layer 200 facing the fitting area 110. Of course, in an actual usage, the pattern layer 300 may cover the side surface of the light-transmittable wrapping layer 200 facing the fitting area 110, either entirely or partially, which should be arranged according to an actual need.

Furthermore, when the light-transmittable wrapping layer 200 is attached to the fitting area 110, an adhesion in a whole may result in generating a place not being attached tightly, thus a window 201 penetrating through the light-transmittable wrapping layer 200 is arranged. On one hand, the window 201 can make the light-transmittable wrapping layer 200 attach closely to the fitting area 110 and discharge any excess air; on another hand, a personalized design, such as displaying a corresponding product logo on the light-transmittable wrapping layer 200, can be satisfied. It should be understood that, in an actual production, in order to adapt to the design of the window 201 in the light-transmittable wrapping layer 200, a corresponding position on the pattern layer 300 should also be left blank without any patterns designed.

In a plurality of embodiments, a plurality of protrusions 210 are uniformly arranged on a side surface of the light-transmittable wrapping layer 200 away from the fitting area 110 to provide a relatively large friction when holding the bottle body 100, so as to prevent the bottle body 100 from dropping from hand. Optionally, the protrusion 210 is in a cylindrical shape or a hemispherical shape.

In some other embodiments, the novel container further comprises a bottle cap 400 which is screwed on an opening. The opening is arranged on the bottle body 100 and has a thread arranged on an outer surface. A suction nozzle 410 is arranged on the bottle cap 400, and protrudes from a side surface of the bottle cap 400 away from the bottle body 100. A straw (not shown in the drawings) which is configured to suck the liquid in the bottle body 100 is arranged inside the suction nozzle 410, and is extended to be arranged inside the bottle body 100.

A principle of the novel container stated above is described in details below in a combination with specific usage scenarios:

The protection layer 500 and the pattern layer 300 are both attached to the side surface of the light-transmittable wrapping layer 200 facing the fitting area 110 by IML process, which makes the pattern layer 300 locate between the protection layer 500 and the light-transmittable wrapping layer 200. Therefore, the protection layer 500, the pattern layer 300 and the light-transmittable wrapping layer 200 are attached to the fitting area 110 through a bonding layer. In the embodiments of the present application, the pattern layer 300 of the novel container is arranged between the light-transmittable wrapping layer 200 and the protection layer 500 to protect the pattern layer 300 effectively and prevent the patterns from wear.

All above, the present application provides a novel container, which comprises: a bottle body, that has a fitting area in a concave shape arranged on an outer surface; a protection layer arranged on the fitting area; a pattern layer arranged on a side surface of the protection layer away from the fitting area; a light-transmittable wrapping layer arranged on the pattern layer; wherein a bonding layer is arranged on a side edge of the light-transmittable wrapping layer, and the light-transmittable wrapping layer connects with a side edge of the fitting area through the bonding layer. The present application, by arranging a fitting area on the bottle body, a protection layer in the fitting area, a pattern layer on the side surface of the protection layer away from the fitting area, and the light-transmittable wrapping layer on the pattern layer, is able to protect the pattern layer effectively. The pattern layer in the novel container provided by the embodiments of the present application is arranged between the light-transmittable wrapping layer and the protection layer, thus the pattern is protected from wear, and the decoration of a product is improved.

Those skilled in the art, upon consideration of the specification and practice of the schemes disclosed herein, will bring out a plurality of other embodiments of the application without any difficulties. Any modifications, uses or adaptations follow the general principles of the present application and comprise common knowledge or conventional technical means in the present technical field that have not been disclosed in the present application are considered to be disclosed by the present application. The specification and embodiments herein are to be regarded as exemplary only, with the true scope and spirit of the application being indicated by the claims.

What is claimed is:

1. A novel container comprising:

a bottle body having a base, an opening, and a sidewall positioned between the base and the opening;

a fitting area arranged on an outer surface of the sidewall of the bottle body, wherein the fitting area has a floor recessed relative to the outer surface of the sidewall of the bottle body in at least locations of the sidewall proximate to the base and the opening, and a side edge connected between the floor and the outer surface of the sidewall of the bottle body;

a protection layer in direct contact with the floor of the bottle body;

a pattern layer in direct contact with a side surface of the protection layer; and a light-transmittable wrapping layer arranged on the pattern layer, wherein the pattern layer is positioned between the protection layer and the light-transmittable wrapping layer, and wherein the pattern layer, the protection layer, and the light-transmittable wrapping layer are positioned within the fitting area and, using an in-molding process, a laminating process, or an extrusion process, the light-transmittable wrapping layer is bonded to the side edge of the fitting area with a bonding layer.

2. The novel container according to claim 1, wherein a plurality of protrusions are arranged on a side surface of the light-transmittable wrapping layer away from the fitting area.

3. The novel container according to claim 1, further comprising a bottle cap screwed on the opening arranged on the bottle body, wherein a thread is arranged on an outer surface of the opening.

4. The novel container according to claim 3, wherein a suction nozzle has a straw inside and is arranged on the bottle cap, wherein the straw is extended to be arranged inside the bottle body.

5. The novel container according to claim 1, wherein the fitting area is arranged symmetrically on the outer surface of the bottle body, and a shape of the fitting area adapts to a shape of the protection layer and a shape of the light-transmittable wrapping layer.

6. The novel container according to claim 2, wherein the plurality of protrusions are in cylindrical shapes or hemispherical shapes.

7. The novel container according to claim 1, wherein a material of the light-transmittable wrapping layer is a transparent elastomer.

8. The novel container according to claim 1, wherein a material of the bottle body is a plastic or a metal.

9. The novel container according to claim 1, wherein a window penetrates through the light-transmittable wrapping layer, wherein a portion of the light-transmittable layer at the window is not attached to the pattern layer, and wherein the window discharges excess air from between the light-transmittable trapping layer and the pattern layer when the light-transmittable wrapping layer is arranged on the pattern layer.

10. The novel container according to claim 1, wherein a material of the protection layer is a plastic.

11. The novel container according to claim 1, wherein the pattern layer, the protection layer, and the light-transmittable wrapping layer do not protrude past the outer surface of the bottle body.

12. The novel container according to claim 1, wherein the pattern layer, the protection layer, and the light-transmittable wrapping layer are laminated together.

13. The novel container according to claim 1, wherein the bonding layer is formed from a different material of the light-transmittable wrapping layer and the bottle body.

14. A novel container comprising:

a bottle body having a base, an opening, and a sidewall positioned between the base and the opening;

a fitting area arranged on an outer surface of the sidewall of the bottle body, wherein the fitting area has a floor recessed relative to the outer surface of the sidewall of the bottle body in at least locations of the sidewall proximate to the base and the opening, and a side edge connected between the floor and the outer surface of the sidewall of the bottle body;

a protection layer;

a pattern layer arranged on a side surface of the protection layer;

a light-transmittable wrapping layer arranged on the pattern layer;

a window formed through the light-transmittable wrapping layer, wherein a portion of the light-transmittable layer at the window is not attached to the pattern layer, and wherein the window discharges excess air from between the light-transmittable trapping layer and the pattern layer when the light-transmittable wrapping layer is arranged on the pattern layer; and wherein the pattern layer is positioned between the protection layer and the light-transmittable wrapping layer, and wherein the pattern layer, the protection layer, and the light-transmittable wrapping layer are positioned within the fitting area and, using an in-molding process, a laminating process, or an extrusion process, the light-transmittable wrapping layer is bonded to the side edge of the fitting area with a bonding layer.

15. The novel container according to claim 14, wherein the pattern layer and the protection layer are in direct contact.

16. The novel container according to claim 14, wherein the bonding layer is formed from a different material of the light-transmittable wrapping layer and the bottle body.

* * * * *